United States Patent [19]

Reader et al.

[11] 4,406,310

[45] Sep. 27, 1983

[54] SECONDARY CARPET BACKING FABRICS

[76] Inventors: Arthur M. Reader, 7939 Shallowmeade La., Chattanooga, Tenn. 37421; Robert D. Evans, 44 Tubbs Springs Dr., Weston, Conn. 06880

[21] Appl. No.: 129,629

[22] Filed: Mar. 12, 1980

[51] Int. Cl.[3] ..... D03D 15/00

[52] U.S. Cl. ..... 139/420 R; 139/391; 428/85; 428/95

[58] Field of Search ..... 139/383 R, 391, 410, 139/419, 420 R, 426 R, 450; 57/246, 356; 28/273, 274, 275; 428/25, 91, 95

[56] References Cited

U.S. PATENT DOCUMENTS

| | | | |
|---|---|---|---|
| 2,783,609 | 3/1957 | Breen | 57/350 |
| 2,852,906 | 9/1958 | Breen | 57/350 |
| 2,869,967 | 1/1959 | Breen | 57/350 |
| 2,958,112 | 11/1960 | Hall | 28/275 |
| 2,994,938 | 8/1961 | Loveland et al. | 28/275 |
| 3,017,737 | 1/1962 | Breen | 57/350 |
| 3,043,088 | 7/1962 | Breen | 57/350 |
| 3,091,913 | 6/1963 | Field | 428/369 |
| 3,309,259 | 3/1967 | Schwartz | 139/391 |
| 3,359,934 | 12/1967 | Schwartz et al. | 139/420 R |
| 3,542,632 | 11/1970 | Eickhoff | 428/91 |
| 3,551,269 | 12/1970 | Marzocchi | 428/268 |
| 3,718,530 | 2/1973 | Watson | 428/96 |
| 3,853,680 | 12/1974 | Daniel | 428/95 |
| 4,051,660 | 10/1977 | Griset | 28/275 |
| 4,138,519 | 2/1979 | Mitchell | 428/95 |
| 4,145,467 | 3/1979 | Malik | 428/91 |
| 4,289,173 | 9/1981 | Miller | 139/420 R |

FOREIGN PATENT DOCUMENTS 1760527 12/1971 Fed. Rep. of Germany .

*Primary Examiner*—Henry Jaudon

*Attorney, Agent, or Firm*—Edward D. C. Bartlett

[57] ABSTRACT

A secondary carpet backing fabric woven from man-made fiber warp and weft yarns, the warp yarns preferably being ribbon, including fibrillated, yarns, and at least some of the weft yarns having a random intermingled array of loops and filaments, weft yarns not having a random intermingled array of loops and filaments preferably being such ribbon yarns. Preferably, the secondary backing fabric has an open weave construction of leno structure. These backing fabrics having unusually strong adhesion because of the open structure of the weft yarns which have the random intermingled array of loops and filaments. Air textured core and effect yarns are especially suitable. Carpets having this secondary backing can be glued down to a floor with good adhesion.

22 Claims, 4 Drawing Figures

SECONDARY CARPET BACKING FABRICS

FIELD OF THE INVENTION

This invention relates to synthetic secondary carpet backing fabrics and to carpets constructed therewith.

BACKGROUND OF THE INVENTION

Although woven carpets have been articles of commerce for many years the use of carpets as floor coverings was limited by the relatively high cost of the slow weaving processes employed. With the development of the much more economical and speedy tufting process the potential markets for carpets and rugs in both residential and contract applications have increased dramatically. In this tufting process synthetic or natural fiber yarns are inserted in the form of tufts into a primary backing by a plurality of needles to form a face pile, as is well known in the art. Until these inserted tufts are attached firmly to the primary backing fabric by some form of an adhesive they are readily removed and a tufted carpet without the adhesive has little value. After applying the adhesive the tufts are locked permanently in place. Frequently a compounded synthetic rubber latex is used as an adhesive but other adhesive systems have been developed including the use of hot melt adhesives and tuft locking is no longer a limiting factor in the marketability and use of tufted carpets.

The simple tufting process has been developed over the years and a wide range of tufted carpet styles are now available for many diverse applications in homes, offices and public buildings. As originally developed the primary backing fabrics were primarily cotton but these were rapidly replaced by jute fabrics. With the continued development of the tufting process these jute primary backing fabrics have been largely replaced by woven polypropylene ribbon or tape fabrics or in some styles by spun bonded polypropylene fabrics. These polypropylene ribbons or tapes are produced either by direct extrusion or in many cases by appropriate slitting of extruded polypropylene film.

Since carpets must be both functional and esthetic the characteristics of the face yarns inserted into the fabric, the ability to apply desired color to such yarns and tufted carpets and the tufting design are very important in determining marketability of the final carpets. Primary carpet backing properties are important in determining tufting performance and hence are related to the carpet design. Thus, the selection of the proper primary backing fabric is important in preventing needle deflection and is particularly important in many types of printed carpets. Although polypropylene fabrics have captured a major share of the primary backing market, jute fabrics are still used primarily in shag carpets and in certain types of molded automotive carpets.

In addition to esthetics many of the physical properties of the tufted carpets are related to the amount and type of face yarn employed and the selection of the primary carpet backing as well as the amount and type of adhesive which is applied. However, in order to enhance dimensional stability and resistance to stresses produced by heavy traffic patterns and other factors, it has been common practice to improve these properties of tufted carpets by using a reinforcement fabric of some type. Frequently the reinforcement is provided by laminating a rather open woven fabric to the underside of the tufted carpet. These reinforcing fabrics or secondary carpet backing fabrics provide the additional reinforcement required for satisfactory performance in many tufted carpet applications. Woven jute fabrics weighing from six to eight or more ounces per square yard have been in common use for many years as secondary carpet backing fabrics and have captured a major share of this reinforcement fabric market.

The process of spinning jute yarns from the non-uniform jute fiber is complex and generally results in a yarn which is relatively open and has many protruding fiber ends. As a result the compounded rubber latex used as a laminating adhesive can readily penetrate both the open reinforcing fabric and the jute yarn. Excellent laminate strength is readily obtained and this is one of the distinct advantages of jute secondary carpet backing fabrics. Unfortunately, jute fabrics have certain deficiencies which, combined with their manufacture in foreign countries with long supply lines, have encouraged the development of improved secondary carpet backing fabrics from synthetic fibers or yarns.

Since jute yarns are based on a natural cellulose product derived from the jute plant by an improved process they are subject to all of the variabilities of natural products and, in addition, they are moisture sensitive and are not inherently mildew resistant. In addition, since jute fiber is grown, spun into yarn and woven into fabric in distant foreign countries, the supply of the fabric is subject to many vagaries which are not always under good control. These factors include the effects of disastrous weather on crop productivity, governmental instability and labor unrest in both the fabric production and transportation areas. The result has been a fluctuating supply situation with rapid and uncertain price changes. As a result the development of a satisfactory secondary carpet backing from domestically produced man-made or synthetic materials which would be under much closer domestic control and which would not have the inherent disadvantages of jute has long occupied the attention of many inventors.

Synthetic fibers with their outstanding uniformity, high strength, lowered moisture sensitivity, dimensional stability and inherent mildew resistance, offer an attractive combination of properties. Polyolefin fibers offer an unusual combination of ready availability, high strength, low moisture sensitivity, mildew resistance and low density. The polyolefins, and particularly polypropylene fibers, are based on either by-products or co-products of the huge petroleum refining or petrochemical industries and as a result have a unique supply situation in the United States. Other synthetic fibers are also based on the hugh petrochemical industry and as a result these petrochemical based synthetic fibers offer an ideal base for the development of a secondary carpet backing.

Although the desirability of developing an all synthetic secondary carpet backing fabric has long been recognized, the solution to this problem has been difficult to achieve because of the many technical and economic requirements which must be met. Schwartz, U.S. Pat. No. 3,309,259, was able to demonstrate that some improvement in dimensional stability could be obtained if only a portion of the secondary carpet backing was made from synthetic materials. In these woven fabrics the warp yarns were either made from polyamides or polypropylene yarns whereas the weft yarns were made from a paper yarn, Kraftcord, or jute.

With the development of woven primary carpet backing from polypropylene ribbon or tape yarns with their very favorable economics, it was natural to consider these fabrics for secondary carpet backings. These synthetic fabrics have high strength, good flexibility and dimensional stability, excellent resistance to moisture and good mildew resistance and can be economically produced from polymers derived either as by-products or co-products of the petroleum refining or petrochemical industries and, therefore, in an excellent supply situation. However, despite these favorable characteristics, attempts to use these ribbon fabrics as secondary carpet backing fabrics failed because of poor adhesion of the wide, relatively smooth yarns in the fabric to the tufted carpet. Although satisfactory adhesion to polypropylene primary carpet backing can be developed for tuft locking by using a carboxylated styrene-butadiene rubber latex, the laminate strength of ribbon fabrics, even using ehse improved latices, is not satisfactory and delamination is a serious problem.

Eickhoff, U.S. Pat. No. 3,542,632, recognizing that ribbon or tape polyolefin fabrics had very poor adhesion to tufted carpets, attempted to solve this problem by subjecting the woven ribbon yarn fabric to mechanical treatments which would fibrillate the yarns in the fabric. The fibrillating methods included sand blasting, mechanical abrasion and needle punching with barbed needles as the preferred method. Fabric design, yarn dimensions, and the amount of needling are reportedly critical in determining the suitability of the fabric for secondary backing. Since it is very difficult to control yarn fibrillation by mechanical action on the woven fabric, the resulting fibrils are usually quite coarse and adhesion, although improved, does not reach satisfactory levels without serious impairment to fabric properties. If the finer fibrils required for good adhesion are to be produced the amount of fabric damage resulting from the much higher needle density is extensive and fabric strength is greatly reduced.

Some of the disadvantages of fibrillating a woven fabric can be overcome by fibrillating a yarn and thereafter weaving a fabric using a fibrillated yarn in at least one fabric direction. Although these fabrics have somewhat improved laminate strength, delamination remains a major problem. It is known that hot melt adhesives give improved laminate strength and tuft binding and fabrics woven from fibrillated yarns have found a limited market as secondary carpet backings in those market areas where hot melt adhesives are used.

Fabrics woven from fibrillated yarns in at least one direction have been subjected to mechanical action to preferentially raise fibers on one side of the fabric as taught by Malik, U.S. Pat. No. 4,145,467. Unlike fabrics woven from spun yarns where mechanical action on these fabrics not only breaks fibers but also physically pulls fibers from the yarn bundle, mechanical action on fibrillated yarns can only be effective by breaking the fiber or network structure. As a result, mechanical action, such as by needle punching with barbed needles or by some other mechanical action as abrasive action, results in somewhat improved laminate strength but greatly decreased fabric strength. Thus, some compromise between laminate and fabric strength must be reached. These fabrics when subjected to carefully controlled mechanical actions and used under controlled conditions have found limited applications.

Since woven jute fabrics have satisfactory adhesion properties to tufted carpets, one of the approaches to producing an all synthetic secondary backing fabric is the use of a spun synthetic yarn. Such yarns can be used in both directions as in the common jute fabrics but for economical reasons attempts have been made to reduce costs by using spun yarns only in the fill direction. Again, for economic reasons, such spun yarns utilize either polyester or preferably polypropylene staple fiber. Since jute yarns are usually quite open and have many loose ends, these characteristics permit latex to penetrate the yarn bundle and improve adhesion. For this reason attempts have been made to develop similar characteristics in the synthetic spun yarns. Again, a compromise between yarn twist and strength must be reached.

One of the characteristics of jute fabrics is its open structure which permits latex to penetrate both the fabric and the yarn bundle as well. Although jute secondary backing fabrics have an open structure the fabrics are reasonably stable, in spite of this open structure, because of the high fiber friction at the yarn crossovers. If similar fabrics are woven using polypropylene ribbon yarns in both directions the friction developed on the smooth ribbon yarns crossovers is quite low and the yarns can be readily displaced. The replacement of the ribbon yarn in the weft direction by a spun polypropylene yarn improves fabric stability slightly but the open fabric is far from satisfactory and the fabrics are readily distorted.

For a number of years open packaging fabrics useful for packaging fruits and vegetables have been woven from polypropylene ribbon yarns using a leno fabric construction. These fabrics have greatly improved stability. Combining the improved adhesion of the synthetic spun yarns with the fabric stability arising from the leno weave pattern, the all synthetic secondary carpet backings which have found the widest acceptance by the trade have used a leno weave pattern with polypropylene ribbon yarns in the warp direction and a spun synthetic yarn, usually of polypropylene, in the weft direction.

Although ribbon-spun yarn secondary carpet backing fabrics produced from synthetic fibers and synthetic spun yarns can have generally satisfactory adhesion properties, the adhesion of these fabrics can be further improved by subjecting the as-woven fabric to mechanical action such as brushing or sanding or the like. Generally such mechanical action is confined to one side of the fabric only but for special purposes both sides of the fabric may be so treated.

Since jute fabrics have been so widely used as secondary carpet backings, process equipment and technology for lamination have been developed over the years for use with these jute fabrics. The acceptance of an all synthetic secondary carpet backing fabric would be greatly enhanced if the same processing equipment used for jute, or at least the same equipment with minor alterations, could be satisfactorily used. As noted, adhesion is related not only to the fabric composition, design and fabrication, but it is also related to the adhesive employed and by the method of application of the adhesive. Since compounded synthetic rubber latices are so widely used by the tufted carpet industry for tuft locking and are so economical, it is preferred that any improved synthetic secondary carpet backing be useful with this adhesive system. Since the strength of the adhesive bond is related in part to the type and amount of latex used, the composition of the latex compound and the method of application and curing of the latex compound, these factors must be considered in the selection and utilization of a secondary carpet backing fabric. Thus, the total cost-performance of the all synthetic fiber secondary carpet backing fabric system becomes a major factor in the acceptability of the fabric by industry.

Although the ribbon-spun yarn leno woven secondary carpet backing fabrics have many desirable properties, the adhesion of the as-woven backing to the tufted carpet is related not only to the fabric design, construction and fabrication, but also to the properties of the spun yarn. Yarn properties are related in turn to stable fiber properties and to the yarn spinning process which is employed. As staple lengths and twist levels are increased to improve yarn strength the number of fiber ends and the ability of the latex to penetrate the yarn bundle is reduced. As a result the laminate bond strength is generally reduced as yarn twist is increased.

Spun yarn costs represent one of the major costs in the production of ribbon-spun yarn leno secondary carpet backing fabrics. These spun yarn costs include not only the costs of converting monomers or polymers into staple fibers but also the very substantial costs of converting staple into spun yarn. These latter charges include not only the very substantial capital charge costs but also the rather high labor costs involved in conventional spinning processes. These costs are so high that major efforts to reduce the costs of converting staple into yarn are under continuous investigation. Although yarn costs have been reduced by the development of open end rotor spinning or by the modified Dreft system, spun yarn costs remain a substantial part of the cost of producing synthetic secondary carpet backing. Furthermore, the large capital investment required for an efficiently sized plant represents a major deterrent to many potential producers of secondary carpet backing.

There have been other proposals for producing secondary carpet backing fabrics which involve either the use of non-woven structure or some modification of this non-woven structure. In several cases the non-woven structures were produced by needle punching processes. Generally those fabrics which are produced soley by needle punching processes have little fabric strength at low fabric weights and fabrics with adequate strength for good reinforcement require so much fiber that fabric costs are excessive. Again, attempts have been made to use woven ribbon fabrics onto which a light coating of fiber have been needled. Generally such fabrics have a rather tightly woven structure which prevents latex from penetrating the needled fabric and since the fabrics are only lightly needled the fibers can be readily pulled out and laminate strengths are low.

Although many processes have been proposed for producing secondary carpet backings major compromises must be reached between the physical properties of the fabric as a reinforcing fabric, the strength of the laminate to the tufted carpet, and the economics of production of the fabric. As a result the development of improved secondary carpet backing fabrics from synthetic fibers remains an active development field. Thus, one of the objectives of this invention is the development of secondary backing fabrics which have controlled but variable levels of adhesion without impairment of fabric physical properties as a reinforcing agent for tufted carpets. Another objective of this invention is the development of secondary carpet backing fabrics with controllable but variable adhesion in the as-woven condition requiring no additional mechanical action as the as-woven fabric. Another objective of this invention is the production of as-woven secondary carpet backing fabrics with controlled high levels of adhesion on both fabric sides without resorting to mechanical action on the as-woven fabric. Another important objective of this invention is the reduction in capital requirements for converting synthetic fibers into yarns and fabrics suitable as secondary carpet backing fabrics. Yet another objective of this invention is the more economical use of synthetic fibers in the development of satisfactory secondary carpet backing fabrics. Other objectives of this invention will be apparent from the description of the invention to those skilled in the art.

SUMMARY OF THE INVENTION

This invention relates to fabrics useful as secondary carpet backing fabrics for tufted carpets in which a portion of the yarn members comprising the fabric have been subjected to a fluid jet in such a manner as to produce an intermingled random array of fibers having an open structure permitting easy penetration of the laminating adhesive into the yarn bundle. The invention relates to fabrics useful as secondary carpet backing fabrics for tufted carpets in which at least a portion of the yarn members comprising the fabric have been treated in fluid jet in such a manner as to produce a random intermingled array of loops and filaments. The invention further relates to similar fabrics useful as secondary carpet backing fabrics in which at least a portion of the yarn in the fabric comprises two or more individual yarns fed into a fluid jet at different rates in such a manner as to produce a core and effect yarn in which the loops and filaments of the effect yarn are intermingled with the fibers of the core yarn in a random array. The invention also relates to secondary carpet backing fabrics in which the man-made fibers comprising the fabrics of the above structure comprise a plurality of chemical types. The invention further relates to secondary carpet backing fabrics of improved dimensional stability in which two or more different types of man-made yarns are intermingled in an open structure including an intermingled random array of loops and filaments and thereafter weaving such yarns either alone or with other man-made yarns to produce fabrics which can be dimensionally stabilized by subjecting such fabrics to a temperature sufficiently high to adhere at least one of the synthetic yarns in the fabric to other yarns in the fabrics.

The invention also relates to carpet having a secondary carpet backing fabric constructed according to the invention and laminated to the underside of a primary backing fabric containing a face pile attached thereto.

DETAILED DESCRIPTION OF THE PREFERRED EMBODIMENTS

Figure 1:
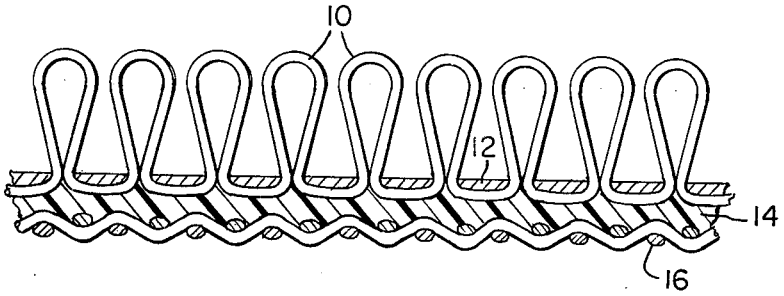
FIG. 1 is a diagrammatic cross-sectional view of a tufted carpet.

The invention relates to the use of a wide variety of yarns which can be treated in a fluid jet to produce yarns which have an intermingled random array of fibers having an open structure. Although the desired yarn structures can be obtained by the use of jets operating with several different fluid mediums, generally the medium preferred will be air and references hereafter to air jets will not be limiting but will include the use of other fluid mediums.

A wide variety of yarns can be treated in these air jets to produce yarns with open structures. The process of treating yarns with air jets has been developed by the E. I. duPont de Nemours and Company under the designation Taslan. The wide variety of yarns which can be produced by this process has been disclosed in a series of patents assigned to duPont such as U.S. Pat. Nos. 2,783,609; 2,852,906; 2,869,967; 2,958,112; 2,944,938; 3,017,737 and 3,043,088. Advances in the design of such jets, in the art of treating yarns in air jets and equipment for processing yarns in air jets to form intermingled arrays of filaments and/or intermingled random arrays of loops and filaments have and are continuing. In addition to the above structures, by proper selection of the yarns fed to the air jet or by control of processing variables and equipment, it is possible to create yarn structures which include a substantial portion of fiber ends.

A wide variety of yarn types which can be treated, either alone or in combination in air jets, include continuous filament, textured continuous filament, fibrillated or spun yarns. However, for economic reasons continuous filament or fibrillated yarns are preferred.

Although man-made or synthetic fiber yarns can be fed to air jets to produce yarns either with the open structure or the random intermingled array of loops and filaments which permit easy penetration of the laminating adhesive into the yarn structure with resulting excellent adhesion to the tufted carpet, the synthetic fibers, particularly polyesters or polyolefins such as polypropylene, are preferred for reasons of economy. In addition such yarns have excellent dimensional stability because of their low moisture absorption.

Equipment for processing yarns with air jets is commercially available from a number of companies.

Basically one or more yarns are overfed to an air jet and the turbulent air stream transforms the relaxed fibers into an intermingled random array of fibers or into a random intermingled array of loops and filaments. These structures become locked into place by interfilament friction prior to packaging. As is well known the processing conditions, including the design of the air jet, the properties and physical characteristics of the yarn or yarns fed to the jet, the rate of overfeed and other processing conditions such as air pressure, amount of drafting and the like, will control the properties and structure of the air jet processed yarns. The actual phenomenon occurring in and immediately after the jet have been the subject of many investigations and the simplified picture presented above is not limiting.

Depending upon the choice of the many processing conditions which can be used to prepare yarns in air jets, it is possible to use of wide variety of feed yarn types to form air jet yarns which have a broad range of structure and properties. Although it is possible to use spun yarns, heavy denier monofilaments, fibrillated yarns and crimped multifilament yarns as one member of a plurality of yarns fed to an air jet, the preferred yarns are continuous multifilament yarns with filament deniers below 25 and preferably in the one to 15 denier range. As filament denier increases at a given total yarn denier, the ability of the air jet to form a random intermingled array of filaments or a random intermingled array of loops and filaments is reduced. Not only is the bending modulus of heavy deniers filaments greatly increased, which must be overcome by the air stream, but also the actual number of fibers which can be intermingled and locked into place by fiber friction is reduced. The net result is that yarns with high filament deniers are less responsive to the action of air jet.

Although the structure of the yarn produced in an air jet can be varied broadly, it is possible to produce yarns with even more open structure by subsequent treatments either in a continuous or in an interrupted process. Thus, if two or more yarns have different shrinkage characteristics, resulting either from different chemical compositions or from different yarn processing conditions, are intermingled in an air jet and then are given a subsequent heat treatment under relaxed conditions, a yarn with even more open structure can be produced.

The ability to feed more than one multifilament continuous filament yarn at individually controlled overfeed rates increases the wide range of yarn properties which can be produced. For example, if one yarn is fed at a feed rate of perhaps 104 to 108% of the packaging rate and the other yarn is fed at much higher rates, perhaps as much as 200%, a so-called core and effect yarn will be produced in which loops of the higher overfed yarn will be formed and intermingled with the filaments of the other yarn in the core. By varying the feeding of the effect yarn it is possible to independently control the amount of yarn which is in the loop form. Thus, it is possible to form secondary carpet backing fabrics from these yarns with peel strengths which can be made to meet individual fabric requirements without greatly altering other desired characteristics.

Obviously a wide range of yarn properties can be produced by this simple inexpensive process by controlling the characteristics of the yarns fed to the jet, the number of yarns and the rate of overfeed, the design of the jet and the post jet processing conditions including overall speed. Since it is possible to feed more than one yarn to the jet, combinations of several different yarn deniers, filament deniers, yarn types and even different chemical fiber types, are possible. Since the action of the air jet is to transform excess filament length into loops, it is possible to control loop formation and hence yarn properties not only by control of overfeed rates but also by control of yarn selection.

In a core and effect yarn for a secondary carpet backing fabric it is possible to increase yarn strength by either using a large denier yarn as the core yarn or by using a high strength yarn at the same denier as the core yarn. Thus, continuous filament yarns with high strength designed for industrial uses can be used as core yarns. Again, if it is desired to increase fabric adhesion, the amount of yarn which is in loop form, or the effect yarn, can be increased either by increasing the total denier of the effect yarn fed to the air jet or at constant feed yarn denier by increasing the amount of yarn overfeed. Thus, it is possible by using this relatively simple process to independently control fabric strength and laminate bond strength by simple control of yarn selection and processing conditions.

As indicated, the ability of air jets to form loops in filaments varies with filament denier. Therefore, it is preferred to form core and effect yarns with medium to heavy denier monofilaments as core yarns and finer denier per filament multifilament yarns as the effect yarns. In some cases it may be found that the heavy denier monofilament yarns used as the core yarns may not be sufficient to give good interlocking of the loops in the effect yarn and in these cases it is preferred to use a multifilament continuous filament yarn in combination with monofilament yarns as the core yarns. Such combination core yarns can give high strength combined with good interlocking characteristics.

Again, yarns of the same chemical type can be used but with different characteristics to produce secondary carpet backings with tailor made characteristics. Thus, if a high modulus high strength fabric is desired, the core yarn can be a high strength polyester industrial yarn. The effect yarn can either be a fully drawn apparel polyester yarn or a partially drawn polyester apparel yarn.

Again, combinations of two different chemical types of yarns can be used. Replacement of the polyester effect yarn in the previous example with a polypropylene effect yarn can be used or even a mixed polypropylene polyester effect yarn can be used.

It should be pointed out that other yarn characteristics can be produced by controlling the denier of the core yarn and the denier and overfeed rate of two effect yarns.

Depending upon the configuration of the jet, the yarns processed and the processing conditions, the yarn emerging from the jet can either be an open intermingled yarn, a yarn comprising a random intermingled array of loops and filaments or loops and filaments of at least one yarn intermingled with filaments of another yarn. Yarns of the above structure, either alone or in combination with other yarns, form woven or knitted fabrics which can be readily laminated to tufted carpets. The invention is not limited to the control of yarn properties by the use of the variables discussed but other variables such as yarn texture, twist levels, twist direction, finish level and other variables familiar to those skilled in the art, are included within the scope of this invention.

Although a wide variety of yarn types, chemical compositions and combinations thereof can be used to produce air jet treated yarns which can be converted by well known processes into fabrics which are especially suited for secondary carpet backing fabrics, it is preferred, for reasons of economy, to use continuous filament yarns either of polyester or of polypropylene. The processes for producing continuous filament yarns from either polyester or polyolefins such as polypropylene have been under continuous modification and developments for years and low conversion cost processes are now commercially available using melt spinning processes. In the case of polyesters continuous polymerization processes feeding directly to melt spinning and drawing units producing continuous filament yarns at very high speeds are very well known and are commercially available from a number of sources. Since color requirements for secondary carpet backing fabrics are not as critical as for apparel uses, natural colored polyester yarns can be used. For esthetic reasons related to market preferences pigmented polyester yarns resembling jute can be readily prepared. More recently polyester polymer arising from the rapidly expanding markets for oriented polyester beverage bottles, either directly as a by-product of this market or from recycled bottles, is becoming increasingly available at relatively low cost. Such polymers can be extruded as natural or jute colored continuous filament yarns using either fully or partially depreciated yarn plants. Since many of the previously used end uses for polyester continuous filament yarns involved either rigorous control of dyeability for apparel yarns or high strength for such industrial uses as tire cord, the production of marginal yarns or yarns not meeting these high standards is substantial. Such yarns with marginal properties for apparel, home furnishing and industrial uses can frequently be used to produce air texture yarns which are satisfactory for use in the fabrication of secondary carpet backing fabrics. Thus, polyester continuous filament yarns arising from these sources can be used as economical sources of feeder yarns for the air jet processed yarns.

In a similar manner polypropylene continuous filament yarns, either natural or pigmented, can be used to produce feeder yarns for air jet processing into very satisfactory secondary carpet backing yarns. Polypropylene resin based on propylene arising either as a by-product of the cracking process for gasoline or as a co-product of the steam cracking of heavy liquid feedstocks to produce ethylene assures an economical supply of this polymer. The conversion of this polymer into continuous filament yarns by melt spinning is well known and practiced by a number of companies. Thus, polypropylene joins polyesters as the preferred fibers for the manufacture of secondary carpet backing fabrics.

The excellent flexibility of the air jet processing system for manufacturing yarns suitable for secondary carpet backing fabrics assures that the system can take full advantage of economical source of either polyester or polypropylene continuous filament yarns. Since, in a given melt spinning system, it is generally more economical to spin heavier denier yarns, full advantage of this can be used to prepare suitable air jet yarns. Thus, yarns can be readily prepared which can be converted into fabrics with laminate bond strengths far exceeding any known requirement. This ability to form high laminate bond strengths together with the resulting flexibility in fabric formation can assure an economical supply of feeder yarns.

In addition to the economical production of yarns fed to the air jets, the production of yarns by air jets is essentially a simple low capital cost process and the production rate of yarns suitable for secondary carpet backing fabrics in terms of yards and/or pounds per hour is high. These factors combined with the low labor involved assures low conversion and investment costs. Such factors are most important considerations in the manufacture of secondary carpet backing fabrics.

Since the invention relates to fabrics which contain at least one yarn member which has been treated in an air jet in such a manner as to give an open random array of filaments or an intermingled random array of loops and filaments, major attention has been given to the characteristics of such air jet treated yarns. A wide range of fabrics can be prepared by well known means from these described yarns either alone or in combination with other yarns to produce fabrics which exhibit excellent adhesion to tufted carpets. The exact equipment used to prepare these useful secondary carpet backing fabrics, whether woven or knitted, will be determined in large part by the characteristics of the fabrics desired other than those related to laminate adhesion. In part, the equipment will be related to that available and to the particular characteristics of the air jet treated yarns which comprise the fabric. Although knitted fabrics can be produced from many of the air jet treated yarns, most of the producers of primary carpet backing fabrics use and are familiar with weaving techniques and, since these manufacturers are potentially also the producers of secondary carpet backing fabrics, most of the interest in producing such fabrics will be based largely on weaving techniques. Thus, the invention is not limited to one particular form of fabric formation but weaving techniques for the reasons cited may be preferred.

Although it is possible to produce excellent secondary carpet backing fabrics using air jet treated yarns in both warp and fill directions, for reasons of economy it is preferred to use these yarns in combination with other less expensive yarns. In many instances yarn members comprise ribbon yarns produced either by direct extrusion or by slit film techniques or fibrillated yarns in various combinations with air jet treated yarns. Thus, air jet yarns, either alone or in various combinations with ribbon or fibrillated yarns, can be used either in the warp or weft direction.

Adequate adhesion of the secondary carpet backing fabric to tufted carpet can be achieved in many different weave patterns by appropriate adjustment of the above yarn combination. Such adjustments are familiar to those skilled in the art of weaving. Thus, a wide range of constructions such as plain, basket, twills, leno and other constructions can be used to give satisfactory adhesions. However, in order for the laminating adhesive to penetrate the yarn bundle a relatively open fabric is preferred. If such open fabrics are woven from the economically preferred ribbon-air jet treated yarn combinations yarn friction at yarn cross-overs is quite low and, therefore, fabric distortion may become serious. For this reason leno constructions are preferred.

Fabrics of this invention can be woven on many loom types. Selection of loom types and manufacturer is dependent in part on the width of fabric desired. Since the demand for wider width fabrics constitutes the majority of the demand for secondary carpet backing fabrics, one of the preferred looms is a shuttleless type with grippers manufactured by Sulzer Brothers, Winterthur, Switzerland. Sulzer looms have been the preferred looms for a number of years for weaving ribbon-ribbon primary carpet backing fabrics in a plain weave but these looms can be modified readily to weave the preferred leno constructions. Sulzer looms used to weave ribbon-ribbon fabrics do not require accumulators for satisfactory weaving. However, for weaving spun yarns and air jet yarns it is preferred to use yarn accumulators. Since the rate of weft insertion is so high and the withdrawal of yarn from the supply package is so high more satisfactory results can be obtained if a yarn accumulator is used. Yarn accumulators are well known to those skilled in the art of weaving and very satisfactory yarn accumulators are supplied by the Leesona Corporation, Warwick, Rhode Island and others.

Various combinations of air jet yarns with other yarns woven in an open pattern give good penetration of the latex adhesive through the fabric and into the yarn bundle and give excellent laminate strengths. Preferred combinations include combinations of air jet yarns with ribbon yarns. Ribbon yarns are more or less flat yarns having rectangular cross sections which are prepared either by direct extrusion into water or by slitting water quenched film followed by controlled stretching and annealing. In addition to ribbon yarns fibrillated polypropylene yarns which are less expensive than conventional multifilament yarns or spun yarns can be used. Since adhesion is controlled largely by the structure of the air jet yarn the selection of the yarn to be used in combination with the air jet yarn will be determined largely by economic factors. Although the air jet yarn can be used either in the warp or weft direction, use in the weft direction is preferred.

The inherent flexibility of the air jet system to prepare controlled composite yarn structures can be used to prepare fabrics with unique properties. Thus, a fabric woven from polypropylene ribbon yarn warp and a composite core and effect yarn weft can be given a selected heat treatment to produce a fabric bonded at the yarn crossovers. Such stabilized fabrics can have an open structure and yet be resistant to distortion. In addition it is possible to stabilize yarn structures using two different types of yarns with different fusing properties as the composite effect yarns. Again, by selective heat treatment it is possible to bond the fibers together at the fiber crossovers. This added flexibility can be used to extend the range of fabrics which can be utilized as secondary carpet backing fabrics.

One of the most important properties of any secondary carpet backing fabric is its peel strength when laminated to tufted carpet. Federal Test Method Standard 191, Textile Test Method 5950 is applicable for this determination. In this method samples of the finished carpet with the secondary backing applied are cut into strips 3 inches wide by 6 inches long with the length dimension in the tufted direction of the carpet which is the warp direction of the primary carpet backing. The secondary backing is separated from the carpet for approximately 1.5 inches on one of the 3 inch strips. The jaws of the tensile tester are set at an initial one inch separation and the loose free end of the secondary backing is clamped in the lower jaw while the loose free end of the carpet is clamped in the upper jaw. The average load required to strip the backing from the carpet is recorded. Three tests of the carpet are made and the results are averaged. Results are reported in pounds per inch of width. This method of testing has been used for the FHA/HUD Standard UM 44C.

For backings of this invention a modified version of this test has been developed using a standard carpet sample and the same standard latex compound. The standard carpet used was obtained from a single tufting run of 5/32 gauge carpet containing 24 ounces per square yard of nylon BCF yarn. The primary backing used was a polypropylene 24×11 fabric manufactured by Amoco Fabrics Company designated Polybac. The standard laminating adhesive used came from a commercial lot of laminating adhesive using a carboxylated styrene/butadiene latex containing 375 parts of a ground calcium carbonate filler per 100 parts of rubber. A 12 inch square sample of the standard carpet was cut and 3 ounces of the standard latex was hand spread evenly over the sample with a spatula. This is equivalent to 27 ounces of latex per square yard, which is the amount frequently used in many commercial laminations. After uniformly spreading the latex over the back of the sample the secondary carpet backing, to be evaluated, was pressed against the latexed carpet and rolled on to it with a weighted roller to simulate the action of the marriage rolls on a commercial range. The roller weighed about 2.5 pounds and was a 3.5 inch diameter cylinder 12 inches long. The exact same method of using the roller on all samples was used to ensure uniformity. After rolling the 12 inch square sample was pressed onto a 11 inch by 11 inch square pin frame with a wire brush and the supported test specimen was then dried in a circulating hot air oven at 270° F. for 10 minutes. After removing from the oven and cooling the test specimens were removed from the pin frames and conditioned for 24 hours under controlled conditions of 70±2° F. and 65±2% relative humidity prior to testing. Test samples, each 3 inches wide and 6 inches long were cut from the dried backed samples and tested by the Feferal Test Method Standard 191, Textile Test Method 5950.

Various combinations of air jet yarns with other yarns woven in a leno pattern give excellent adhesion and good dimensional stability. Thus, ribbon yarns or fibrillated yarns of polyolefins including polypropylene can be used in the warp direction and air jet treated yarns can be used in the weft direction. The adhesion of many of these fabrics to tufted carpets is so strong that attempts to measure the bond strength by measuring the peeling force result in pulling the face yarns through the primary backing. In many instances it is possible to substitute alternate picks of air jet yarn either with ribbon yarns or fibrillated yarns. Such fabrics with alternate picks can be readily woven on gripper looms ith only rather simple modifications.

Depending upon the desired laminate bond strength it is frequently possible to produce satisfactory fabrics by using air jet treated yarns in every third or fourth pick. The yarn costs of such fabrics with ribbon yarn warps and with air jet treated yarns in various combinations with ribbon yarn or fibrillated yarn in the weft can be quite economical. However, the costs of a loom capable of weaving such fabrics may be quite high and weaving costs may offset some of the advantages of using these economical yarn combinations. Since fabrics can be prepared which exhibit outstanding fabric strength as well as laminate strength to tufted carpets the invention gives much needed flexibility to the entire fabric forming system and permits the tailoring of a fabric for any desired fabric and laminate strength. Thus, the control of yarn characteristics coupled with the fabric constructions are tools which the fabric designer can use to tailor make secondary carpet backing fabrics. Prior to this invention such flexibility has been sorely missing. Since adhesion of the secondary carpet backing fabric to the tufted carpet is such an important factor in the successful use of such reinforcing fabrics the flexibility of the air jet yarn preparatory process in independently controlling laminate bond strength is a most important advantage of the system. Since it is possible to independently control laminate bond strength the use of at least one air jet yarn member in a secondary carpet backing fabric gives additional flexibility in controlling fabric strength. Thus, it is possible to control fabric strength by control of the strength of the air jet yarn, the strength of the other yarn members of the fabric, and by the fabric design. Since no mechanical treatment of the as-woven fabric is required, which frequently impairs fabric strength, the fabric strength at a desired level can be controlled by these factors. Thus, the invention permits the independent control of laminate strength as well as fabric strength. Methods of measuring and control of fabric strengths are well known to those skilled in the art.

With many secondary carpet backing fabrics, if high laminate strength is required, some form of mechanical treatment of the as-woven fabric may be required. As a result the strength of the laminate bond to the tufted carpet will vary with the face of the fabric used. Since the development of satisfactory laminate strength has been a continuing problem generally the mechanical treatment has been directed to one fabric surface and as a result the laminate strength of the untreated surface has been greatly reduced. This reduced bond strength has been a serious disadvantage in those carpets which are installed by glue down procedures. Since no mechanical action to improve adhesion is required the fabrics of this invention have the same adhesion value on both fabric surfaces. As a result the installation by glue down techniques of carpets having secondary backing fabrics of this invention has been entirely satisfactory.

Although it is not necessary to treat the as-woven fabrics of this invention by mechanical action to give fabrics with adequate adhesion to tufted carpets, fabrics with special properties can be developed by selected mechanical action. Fabrics containing spun yarns, when subjected to brushing or napping, produce fabrics with more fiber ends on the fabric surface primarily by raising existing fiber ends on the yarn surface or by pulling fibers from the yarn bundle. In contrast, the treatment of fabrics containing air jet yarns by similar mechanical actions results in a fabric with more fiber ends primarily by breaking the fibers. Since air jet yarns may contain many arrays of loops and filaments in core and effect yarns it is possible to preferentially break the fibers in the loops without seriously impairing the strength of the yarn. Furthermore, by similarily placing partially drawn fibers in the loops and subjecting fabrics containing such partially drawn fibers to brushing or napping, the length of such loops can be extended by a fiber drawing process with greatly improved laminate strengths. Since fabrics woven with air jet yarns may have many loops on the fabric and yarn surfaces the efficiency of brushing such fabrics is quite high.

Reference will now be made to the accompanying drawing.

FIG. 1 diagrammatically illustrates a well known tufted carpet construction having tufts 10 of face yarn inserted in a primary carpet backing 12, laminated by a layer of latex, 14 to a woven secondary carpet backing 16.

Figure 2:
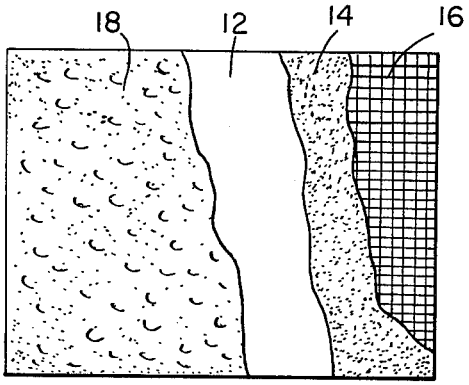
FIG. 2 is a schematic plan view of the carpet of FIG. 1 with parts thereof cut away to expose the different layers.

FIG. 2 illustrates schematically in plan view the various layers of the tufted carpet. As is known, uppermost is the face pile 18, then the primary carpet backing 12, next the layer of latex 14, and at the bottom the secondary carpet backing 16.

Figure 3:
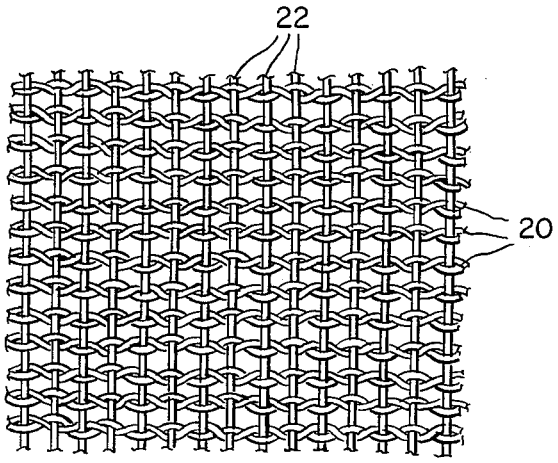
FIG. 3 is a diagrammatic representation of a secondary carpet backing.

FIG. 3 illustrates diagrammatically a secondary carpet backing of well known leno structure and having, as is also known, ribbon yarns 20 in the warp. The weft or filling yarns 22 in accordance with the invention are air textured yarns.

Figure 4:
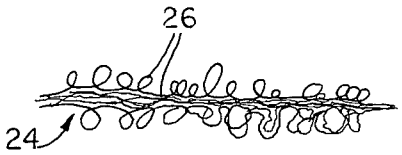
FIG. 4 is a diagrammatic representation of an air jet treated yarn.

FIG. 4 illustrates diagrammatically a known air textured filament yarn 24 having a random intermingled array of loops and filaments 26 such as shown in U.S. Pat. Nos. 2,783,609; 2,852,906; 2,869,967; 2,017,737; and 3,043,088 referred to previously.

The description of the invention is illustrated but not limited by the following examples.

EXAMPLE 1

An air jet yarn machine manufactured by the Enterprise Machine Company, New Castle, Del., known as a Sidewinder model and fitted with three yarn feed rolls, an after jet roll and a surface driven take up unit, was used to prepare an air jet core and effect yarn. The feed rolls, after jet rolls, and take up unit could be driven at individually controlled speeds. The effect yarn in this example was a 300 denier polypropylene multifilament yarn and was fed to the air jet at a speed of 200% of the take up speed (100%). Similarly the core yarn was a 1200 denier continuous filament polypropylene yarn fed to the air jet at a speed of 103% of the take up speed. The after jet roll speed was set at 90% of the take up speed. The take up speed, established as 100%, was 250 yards per minute. The air jet was operated at 120 psig. Yarn produced under the above conditions had an average denier of 1800 and physical examination of the yarn showed that it was composed of an intermingled array of loops and filaments.

A leno fabric having 18 warp ends per inch of 500 denier polypropylene ribbon yarn similar in properties to that used for weaving polypropylene primary carpet backing and 10 ends per inch in the weft direction of the above air jet core and effect yarn was woven on a loom manufactured by Sulzer Brothers, Winterthur, Switzerland. Fabric weaving proceeded with no difficulty.

This fabric was laminated to the standard nylon carpet sample using the modified Federal Test Method Standard 191 previously described. After laminating and storing for 24 hours under controlled conditions the samples were tested for laminate bond strength using the Federal Test Method Standard 191 Test Method 5950 procedure. The laminate bond strength was so high that it was impossible to separate the secondary backing from the tufted carpet without pulling the face fibers through the primary backing. Those familiar with evaluating laminate bond strength of secondary carpet backing to tufted carpet will recognize that the bond strength is far greater than that encountered with most commercial carpets. Thus, the secondary carpet backing as woven and without any subsequent mechanical treatment had a laminate bond strength which was greater than that required.

EXAMPLE 2

The same equipment as employed in Example 1 was used to prepare the air jet entangled yarn of Example 2. The effect yarns consisted of two continuous filament polypropylene yarns of 300 denier each and were fed to the air jet at 200% of take up speed. The core yarn was again a 1200 denier polypropylene continuous filament yarn fed at 104% of take up speed while the after jet roll was fixed at 95% of take up speed. The take up speed was fixed at 280 yards per minute. The air jet was supplied with compressed air at 110 psig. The yarn produced under these conditions had an average denier of 2400 and consisted of a random intermingled array of loops and filaments.

A leno secondary carpet backing fabric was woven on a Sulzer loom using 18 ends per inch of 500 denier polypropylene ribbon yarn in the warp and 9 ends per inch of the above air jet in the weft direction.

The secondary carpet backing fabric was laminated to the standard carpet sample using the procedures described previously and outlined in Example 1. Again, attempts to determine laminate strength by pulling a test strip of the secondary carpet backing from the laminated carpet were unsuccessful because the bond strength was so high that the nylon face fibers were pulled through the primary backing. As noted in Example 1 this bond strength is much higher than that encountered with jute or with many synthetic secondary carpet backing fabrics. It should be noted as well that this high bond strength was achieved with the as-woven fabric.

EXAMPLE 3

An air jet entangled yarn was prepared using the same equipment and procedures as in Example 2 except that two polypropylene continuous filament yarns of 420 denier each were used as the effect yarns. The average denier of air jet treated yarn was about 2900 and consisted of a random intermingled array of loops and filaments.

A leno secondary carpet backing fabric was woven on Sulzer looms using 16 ends per inch of 500 denier polypropylene ribbon yarns in the warp direction and 8 end per inch of the air jet treated yarns in the weft direction.

The above fabric was laminated to the standard tufted nylon carpet using the same procedures as previously described for Examples 1 and 2. Attempts to measure laminate bond strength were again unsuccessful because the nylon face fibers were pulled through the primary backing.

The above secondary carpet backing fabric has a very open structure and the fabric is an open two sided fabric. After lamination to tufted carpet the fabric is still sufficiently open and contains a sufficient number of loops to ensure good adhesion to the floor in a glue-down installation. This characteristic is most important for this rapidly growing method of installing carpet and is a particular advantage in contract carpet applications.

EXAMPLE 4

Using the same equipment as in Example 1, an air jet entangled yarn was prepared using a 300 denier continuous filament polypropylene yarn pigmented to a jute like color fed at 200% of take up speed as the effect yarn and a similarly pigmented 600 denier continuous filament polypropylene yarn fed at 104% of take up speed as the core yarn. The after jet roll speed was 95% of take up speed and the latter was 400 yards per minute. The air jet operated at 120 psig. Examination of this yarn showed that it comprised a random intermingled array of loops and filaments and that it has an average denier of 1200.

The above air jet treated yarn can be woven into leno secondary carpet backing fabrics using 18 ends per inch of 500 denier polypropylene ribbon yarns in the warp direction and 9 ends per inch of the air jet treated yarns in the weft direction. A sample of this fabric is then laminated to the standard tufted nylon carpet using the laminating procedures previously described. Under these conditions a satisfactory laminate bond strength will be developed.

EXAMPLE 5

A core and effect yarn can be produced on equipment similar to that used in Example 1 using an 840 denier nylon 66 yarn as the core yarn fed at 104% of take up speed and a 300 denier polypropylene yarn fed at 200% of take up speed with the after jet roll at 95% to take up speed. The take up speed is 300 yards per minute with the air jet operating at 120 psig. The average denier of the air jet yarn is about 1450.

The above yarn can be woven into a secondary backing fabric using an 18×9 leno construction with 500 denier polypropylene ribbon yarn as the warp yarn. The peel strength of the above fabric on lamination to tufted carpet will be very high.

EXAMPLE 6

Using the Sidewinder equipment of Enterprise Machine Company for air jet entangling yarns, a polyester core and effect yarn can be produced using 840 denier polyester yarn fed at 104% of take up speed as the core yarn and two 150 denier polyester yarns fed at 200% of take up speed as the effect yarn. The resulting air jet entangled yarn had an average denier of 1450.

The above yarn is woven into an 18×9 leno secondary backing fabric with 500 denier polypropylene ribbon yarn as the warp yarns. On lamination to a tufted carpet the laminate bond strength as determined by a standardized test procedure will be quite high.

EXAMPLE 7

An all polyester air entangled core and effect yarn can be produced on the Enterprise Sidewinder air jet yarn entangling equipment using 840 denier polyester yarn as core yarn and fed at 105% to take up speed and two 270 denier POY polyester yarns fed at 200% of take up speed as the effect yarns. The average denier of the entangled yarn will be about 1930 and will consist of a random intermingled array of loops and filaments.

The above air jet entangled yarn can be woven into an 18×9 leno fabric using 500 denier ribbon polypropylene yarn in the warp direction and the entangled yarn in the weft direction. Laminate bond strength of this fabric to tufted carpet is satisfactory. This example illustrates the possible use of off-grade yarns as effect yarns arising from the very large production of partially oriented polyester feeder yarns produced for the false twist texturized yarn industry.

EXAMPLE 8

An 18×9 leno secondary carpet backing fabric is prepared using 500 denier ribbon polypropylene yarns as the warp yarns and alternate picks of a 1000 denier fibrillated polypropylene yarn and the air entangled yarn of Example 3. The peel strength of this fabric on lamination to tufted carpet will be quite high.

EXAMPLE 9

An air entangled yarn is prepared by feeding an 840 denier polypropylene yarn to the air jet at 150% of take up speed with the after jet roll at 95% of take up speed. The take up speed was 300 yards per minute with the air jet supplied with air at 120 psig. The resulting yarn consisted of a random intermingled array of filaments and will have an average denier of about 1250. The yarn is woven into the usual 18×9 leno fabric. On laminating to a tufted nylon carpet the peel strength is sufficiently high that the fabric can be used as a secondary carpet backing fabric in many carpet applications.

EXAMPLE 10

A core and effect yarn can be produced using the equipment of Example 1 in which an 840 denier polyester yarn fed at 104% of taken up speed was used as the core yarn and an 840 denier polypropylene yarn fed at 200% of take up speed was used as the effect yarn. The average denier of the entangled yarn was about 2500 and the yarn consisted of a random intermingled array of loops and filaments.

A plain woven 24×10 fabric can be produced using 500 denier polypropylene ribbon yarns in the warp and the air entangled yarn in the weft direction. The peel strength of the above fabric laminated to tufted carpet is satisfactory for most secondary carpet backing applications.

EXAMPLE 11

A core and effect yarn is produced on the equipment of Example 1 using an 840 denier polypropylene yarn as the core yarn and two 300 denier cellulose acetate yarns as the effect yarns. The core yarn is fed at 104% of take up speed while the effect yarns are fed at 225% of take up speed. The air jet used compressed air at 120 psig. The yarn has an average denier of about 2200.

An 18×9 leno secondary carpet backing fabric can be woven on a Sulzer loom using this entangled yarn in the weft direction and 500 denier polypropylene ribbon yarns in the warp direction.

The peel strength of this fabric on lamination to a tufted carpet is sufficiently high for most secondary carpet backing fabric applications.

EXAMPLE 12

Using the equipment of Example 1, a 1200 denier bulked continuous filament nylon 66 yarn and a 1200 denier nylon 66 continuous filament yarn are fed to an air jet operating at 120 psig at 120% of take up speed with the after jet roll operating at 95% of take up speed. Take up speed is 250 yards per minute. The resulting intermingled array of filaments is bulked more fully by subjecting the intermingled yarn in a relaxed condition to steam at a temperature of 240° F. and forms a yarn with an open structure.

A leno fabric with an 18×9 construction can be woven using the entangled yarn in the weft direction and 500 denier polypropylene ribbon yarn in the warp direction. This fabric when laminated to tufted carpet as a secondary carpet backing fabric will have sufficiently high laminate bond strength for many carpet applications.

We claim:

1. A secondary carpet backing fabric woven from man-made fiber warp and weft yarns, said warp yarns being ribbon yarns, and at least every fourth weft yarn having a random intermingled array of loops and filaments, weft yarns not having a random intermingled array of loops and filaments being ribbon yarns.

2. The secondary carpet backing fabric of claim 1, wherein said yarns having a random intermingled array of loops and filaments alternate with ribbon yarns.

3. The secondary carpet backing fabric of claim 1, wherein all weft yarns are yarns having a random intermingled array of loops and filaments.

4. The secondary carpet backing fabric of claim 1, wherein at least some of the ribbon yarns are fibrillated.

5. The secondary carpet backing fabric of claim 1, 2, or 3, wherein at least some of the warp yarns are fibrillated.

6. The secondary carpet backing fabric of claim 1, wherein said yarns having a random intermingled array of loops and filaments are core and effect yarns, in which the loops and filaments of the effect yarns are intermingled with the fibers of the core yarns in a random array.

7. The secondary carpet backing fabric of claim 6, wherein the core and effect yarns are polypropylene.

8. The secondary carpet backing fabric of claim 6, wherein the core yarn is nylon and the effect yarn is polypropylene.

9. The secondary carpet backing fabric of claim 6, wherein the core and effect yarns are polyester.

10. The secondary carpet backing fabric of claim 6, wherein the core yarn is polyester and the effect yarn is polypropylene.

11. The secondary carpet backing fabric of claim 6, wherein the core yarn is polypropylene and the effect yarn is cellulose acetate.

12. The secondary carpet backing fabric of claim 6, wherein the core and effect yarns are nylon.

13. The secondary carpet backing fabric of claim 6, wherein the core and effect yarns differ in chemical composition.

14. The secondary carpet backing fabric of claim 6, wherein the two fibers differ in physical properties.

15. The secondary carpet backing fabric of claim 6, wherein the effect yarn is only partially drawn.

16. The secondary carpet backing fabric of claim 6, wherein each core yarn comprises a monofilament yarn and a continuous multifilament yarn.

17. The secondary carpet backing fabric of claim 6, wherein the core and effect yarns are subjected to heat treatment prior to weaving.

18. The secondary carpet backing fabric of claim 1, wherein the yarn having the random intermingled array of loops and filaments has a denier no greater than 2,900.

19. The secondary carpet backing fabric of claim 18, wherein said denier is 1,250 or less.

20. The secondary carpet backing fabric of claim 1, having a leno structure.

21. The secondary carpet backing fabric of claim 6, wherein the core yarn is a high strength industrial yarn.

22. A secondary carpet backing fabric woven from man-made fiber warp and weft yarns having a leno structure, said warp yarns being polypropylene ribbon yarns and said weft yarns having a random intermingled array of polypropylene fiber loops and filaments.

* * * * *